US005438768A

United States Patent [19]

Bauerfeind

[11] Patent Number: 5,438,768

[45] Date of Patent: Aug. 8, 1995

[54] SOLE INSERT

[75] Inventor: Hans B. Bauerfeind, Kempen, Germany

[73] Assignee: Bauerfeind GmbH & Co., Germany

[21] Appl. No.: 256,267

[22] PCT Filed: Dec. 21, 1992

[86] PCT No.: PCT/EP92/02966

§ 371 Date: Jul. 6, 1994

§ 102(e) Date: Jul. 6, 1994

[87] PCT Pub. No.: WO93/13685

PCT Pub. Date: Jul. 22, 1993

[30] Foreign Application Priority Data

Jan. 9, 1992 [DE] Germany ..... 42 00 362.8

[51] Int. Cl.[6] ..... A43B 13/38

[52] U.S. Cl. ..... 36/44; 36/43; 36/165

[58] Field of Search ..... 36/44, 43, 71, 31, 140, 36/165

[56] References Cited

U.S. PATENT DOCUMENTS

| | | | |
|---|---|---|---|
| 1,675,711 | 7/1928 | Jones | 36/140 |
| 1,768,491 | 6/1930 | Richardson et al. | 36/43 |
| 2,865,097 | 12/1958 | Vollrath, Jr. et al. | 36/44 |
| 3,859,740 | 1/1975 | Kemp | 36/71 |
| 4,694,590 | 9/1987 | Greenwalt . | |
| 4,841,648 | 6/1989 | Shaffer et al. | 36/43 |
| 5,014,706 | 5/1991 | Phillip . | |
| 5,042,175 | 8/1991 | Rowen et al. | 36/43 |
| 5,170,572 | 12/1992 | Kantro | 36/44 |

FOREIGN PATENT DOCUMENTS

| | | | |
|---|---|---|---|
| 0387505 | 1/1990 | European Pat. Off. . | |
| 2539966 | 8/1984 | France | 36/43 |
| 845557 | 8/1952 | Germany . | |
| 7835628 | 11/1970 | Germany . | |
| 7831386 | 5/1979 | Germany . | |
| 3323156 | 12/1983 | Germany . | |
| 4200362 | 7/1993 | Germany | 36/43 |
| 291168 | 6/1953 | Switzerland | 36/43 |
| 626793 | 12/1981 | Switzerland . | |
| 673377 | 3/1990 | Switzerland | 36/43 |
| 2189372 | 10/1982 | United Kingdom . | |
| 1729427 | 4/1992 | U.S.S.R. | 36/43 |

*Primary Examiner*—Steven N. Meyers

[57] ABSTRACT

Described is an insole made of elastic material with recesses designed to accommodate replaceable elastic inserts. At least in the zone in which the inserts are located, the insole has, on the same side as the recesses, a first layer of Velcro TM fabric with apertures which fit over the recesses, the first layer acting as a supporting layer for another second layer of Velcro TM fabric which covers it completely, including the inserts.

10 Claims, 1 Drawing Sheet

SOLE INSERT

BACKGROUND OF THE INVENTION

1. Field of the Invention

The invention concerns an insole of elastic material with recesses for taking up exchangeable elastic inserts. A treatment of the foot can be obtained by exchangeable inserts and being able to exercise a greater or lesser pressure at the places of the inserts in comparison to the pressure derived from the material of the inserted sole.

2. Description of the Prior Art

Such an inserted sole is known from DE Patent 845,557, in which the recesses consist of stampings that have penetrated through the material.

Another form of such an inserted sole is described in DE OS 3,713,786, wherein the recesses do not penetrate in the side turned toward the sole of the foot in the inserted sole, but rather true cavities are provided, in which inserts are fitted.

A problem arises in such inserted soles with respect to holding the inserts. Nothing is disclosed in DE Patent 845,557 in this respect. In DE OS 3,713,786, a measure is described for this purpose, which is to provide the sides of the insert adjacent the bottom of the recess with an adhesive. A tight fastening of the inserts is accomplished in this way for the inserts used for the first time, but the adhesive rapidly loses its adhesive force, if the insert is changed several times, which is always the case when there is the necessity within the scope of treatment to use inserts of varying elasticity.

SUMMARY OF THE INVENTION

The invention provides a simple and secure means for holding the inserts, which makes possible a practical exchange of the inserts that can occur as frequently as desired.

According to the invention at least over the region of the inserts, the inserted sole is provided on the side of the recesses with a first layer of a flat adhesive seal as a bearing part, leaving open the recesses, and over this bearing part. Another or second layer of the flat adhesive seal, including the inserts, extends as a covering part.

The furnishing of the inserted sole with a bearing part of a flat adhesive seal, leaving the recesses open, which can be accomplished, e.g., by a permanent adhesive seal which makes it possible, after introducing the inserts, to provide these inserts and the regions of the inserted sole free of inserts with the covering part of the adhesive seal, which holds these inserts securely in their recesses on the basis of its covering of these inserts. Thus, the property of the adhesive seal is utilized, and the covering part can be pulled off the bearing part, without these parts losing their capability of again joining and adhering to each other. By means of flat adhesive seals configured in this way, it is therefore possible without anything further to secure the inserts in their recesses and to change them in a practical manner as often as desired.

Appropriately the padded part or pile is used as the bearing part, and the burred part or hooks of the flat adhesive seal is used as the covering part. In this case, the inserted sole offers a soft support by means of the padded part with respect to the inner sole of a shoe, if by mistake the covering part is not applied.

If the covering part is extended only over the region of the inserts, there results a corresponding savings in material for the covering part and also for the bearing surface with the same extension. For reasons of manufacture, the bearing part may also extend essentially over the entire inserted sole. In this case, the covering part may also be formed in the appropriate dimensions, i.e., the covering part also extends over the entire bearing part.

In order to provide the inserted sole itself with a good adhesive bond to the inner sole of the shoe, adhesive parts can be provided next to the region of the inserts, which are joined with the inserted sole on the side of the bearing part, to penetrate the holding or covering part, and are provided with a layer of self-adhering adhesive turned away from the inserted sole. An inserted sole configured in this way is held against slipping on the inner sole by means of the adhesive seal after it has been inserted in a shoe. The adhering part may or may not be provided with a covering sheet. Appropriately, the design of the finished inserted sole with inserts, flat adhesive seal, as well as adhering parts with a covering sheet is produced, since this assembly cannot slip.

An example of embodiment is shown in the drawing.

DESCRIPTION OF THE PREFERRED EMBODIMENTS

Figure 1:
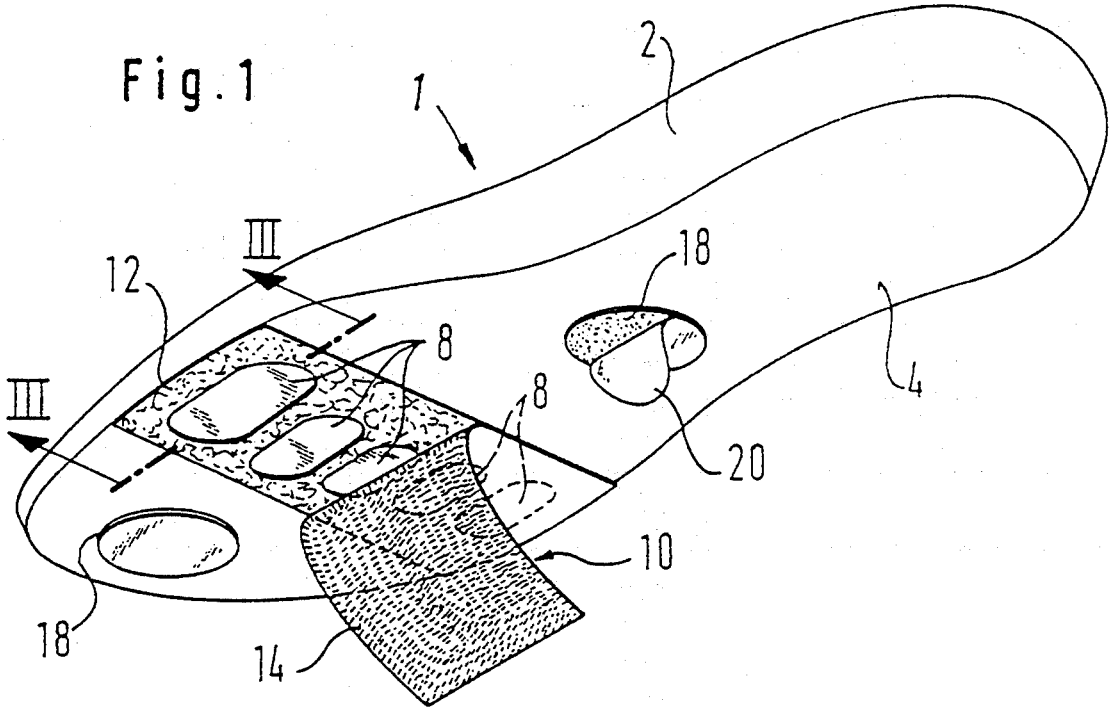
FIG. 1 shows an inserted sole obliquely viewed from below with inserts, which are enclosed by a covering part extending only over the region of the inserts.
Figure 3:
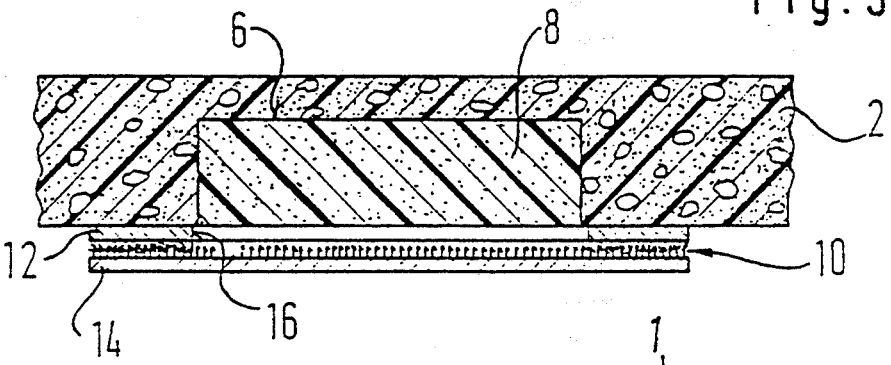
FIG. 3 shows a section along line III—III of FIG. 1.

The inserted sole 1 shown in FIG. 1 consists of the sole part 2 of a flexible material, e.g., silicone rubber, into the underside 4 of which recesses 6, viewed from FIG. 3, are made. The inserts 8 adapted to the latter are inserted into recesses 6, and these inserts are also made of elastic material, e.g., silicone rubber. On underside 4 of sole part 2, in the region of inserts 8, the bearing part 12 of a flat adhesive seal (10) is attached (e.g., by gluing) which leaves space for inserts 8, and covering part 14 extends over this. The covering part is represented in FIG. 1 partially drawn away from bearing part 12. Bearing part 12 and covering part 14 have the same dimensions, so that covering part 14 completely covers bearing part 12, if the covering part is completely pressed down on bearing part 12. In the pressed position of covering part 14, which is shown in the region of the two right inserts, covering part 14 solidly holds inserts 8 in their recesses, so that the latter cannot fall out when the inserted sole 1 is worn. In the case of the drawn-away covering part 14 (see the three left inserts 8), inserts 8 may be removed from their recesses and can be replaced by other, e.g., harder or softer inserts, depending on the desired therapeutic effect. Adhesive seal 10 therefore provides for a secure adhering of covering part 14 onto bearing part 12, whereby the known function of the adhesive seal provides for the fact that covering part 14 can be withdrawn repeatedly from bearing part 12 and can be again pressed onto the latter, whereby a secure fastening of inserts 8 in their recesses 6 is constantly assured.

Further, adhering parts 18 are glued onto the underside 4 of sole part 2, and these are provided with a self-adhering layer, over which covering sheet 20 is applied. After withdrawing covering sheet 20 from adhering parts 18, the inserted sole 1 may be inserted into a shoe, in which inserted sole 1 is then given a secure position based on the adhesive effect of adhering parts 18.

Figure 2:
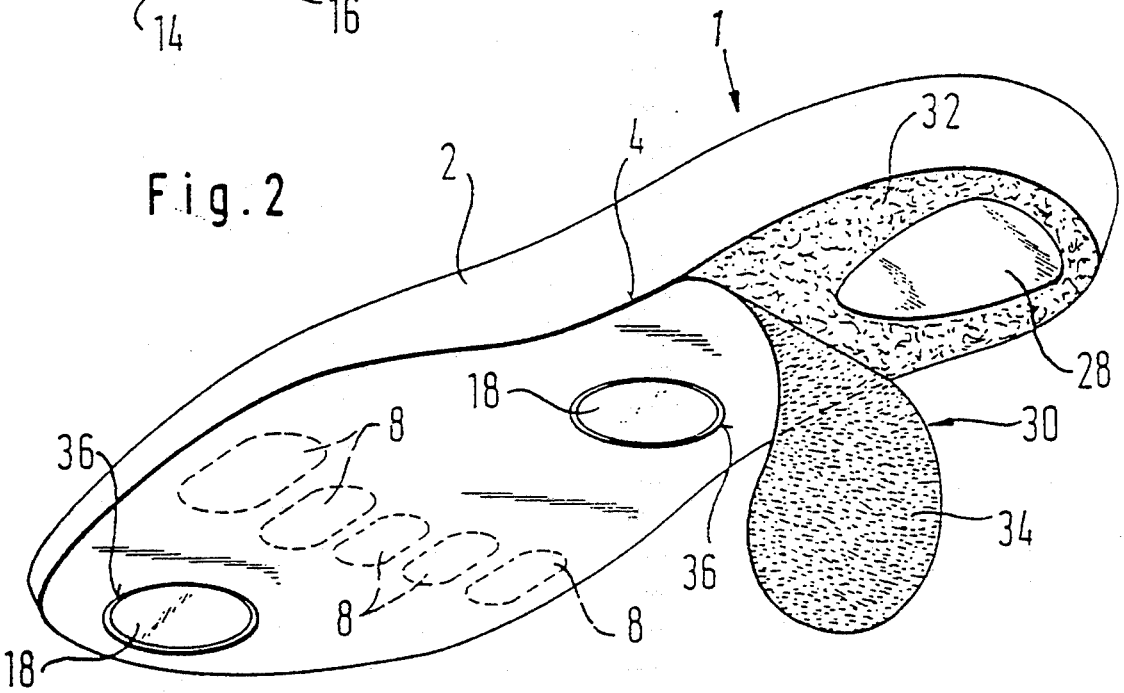
FIG. 2 shows a variant of the form of embodiment according to FIG. 1 with bearing part and covering part extending over the entire inserted sole.

In FIG. 2 is shown an inserted sole 1 with a sole part 2, which is provided with five inserts 8, as in the inserted sole 1 according to FIG. 1, in the region of the toe joint, and these inserts are inserted into recesses corresponding to the form of embodiment shown in FIG. 1. In addition to these inserts 8, insert 28, in sole part 2, is inserted into a corresponding recess, by means of which a greater or lesser pressure can be exercised on the heel. The introduction of insert 28 in sole part 2 is conducted in the same way as is the case for inserts 8. This will be described individually in connection with FIG. 3.

Sole part 2 according to FIG. 2 is provided on its entire underside with bearing part 32 of adhesive seal 30, whose covering part 34, like bearing part 32, covers underside 4 of the entire sole part 2. Thus the regions of inserts 8 and 28 are left open by bearing part 32 (as in the form of embodiment according to FIG. 1), and thus the respective inserts 8 or 28 can be changed when cover part 34 is withdrawn.

As in the case of the form of embodiment according to FIG. 1, inserted sole 1 according to FIG. 2 is provided with holding parts 18, which penetrate covering part 34, which is provided for this purpose with recesses 36. Covering parts 18 are adhered onto bearing part 32 with their side turned toward sole part 2. Then by means of holding or covering parts 18, as in the form of embodiment according to FIG. 1, inserted sole 1 can be attached in an adhesive manner in a shoe according to FIG. 2.

The section represented in FIG. 3 along line III—III from FIG. 1 shows the introduction of an insert 8 into a recess 6 of sole part 2. Bearing part. 12 from FIG. 1 (in the form of embodiment according to FIG. 2 this would be bearing part 32) is glued onto sole part 2, and this bearing part is provided in the region of inserts 8 with recesses 16, by means of which inserts 8 can then be removed and again inserted. Covering part 14, which forms adhesive seal 10 together with bearing part 12, is pressed onto bearing part 12, whereby covering part 14 is formed as the burred part and bearing part 12 is formed as the padded part of the flat adhesive seal. This arrangement has the advantage that when covering part 14 is omitted, padded part 12 presses against the inside sole of the respective shoe, and if this were not the case, if rather bearing part 12 were formed of the burred part, a roughness would result due to the individual hooks of the burred part.

In the forms of embodiment of the inserted sole represented in the figures, the latter is provided with inserts and adhesive seal on its underside 4, thus the side turned toward the inner sole of the shoe. However, it is also possible to provide the inserts with the respective recesses and adhesive seal covering on the upper side of the inserted sole. In this case the adhesive seal covering would be turned toward the sole of the foot. The adhering parts for fastening the inserted sole to the inner sole of the shoe would thus of course remain on the underside of the inserted sole.

I claim:

1. An insole (1) constructed of an elastic material having recesses (6) therein on one side containing exchangeable elastic inserts (8,28), the insole (1) including, on the side containing the recesses (6), a first layer (12,32) comprising a bearing part of a flat adhesive seal (10,30), said bearing part containing spaces corresponding to and overlying said recesses (6) and extending at least over an area directly adjacent to said inserts (8,28), and a second layer (14,34) comprising a covering part of the flat adhesive seal which overlies and is releasably fastened to said bearing part of said seal (10,30), said covering part covering at least said inserts (8,28) and adjacent areas to hold said inserts in place.

2. The insole according to claim 1 further comprising in that, on the side of the insole (1) on which the bearing part resides, and adjacent the inserts (8,28), adhering parts (18) are secured to the insole (1), said adhering parts (18) extend through similarly sized openings in the covering part and are provided with a layer of self-adhering adhesive on the side of the adhering part opposite from that side in contact with the insole (1).

3. The insole according to claim 1, further characterized in that said bearing part (12, 32) is formed with pile, and said covering part (14, 34) formed with hooks, the pile and hooks constituting the flat adhesive seal (10, 30).

4. The insole according to claim 3, further characterized in that covering part (14) only extends adjacent said inserts (8).

5. The insole according to claim 3, further characterized in that bearing part (32) extends essentially over the entire insole (1).

6. The insole according to claim 1, further characterized in that covering part (14) only extends adjacent said inserts (8).

7. The insole according to claim 1, further characterized in that bearing part (32) extends essentially over the entire insole (1).

8. The insole according to claim 7, further characterized in that covering part (34) extends over the entirety of said bearing part (32).

9. The insole according to claim 1 wherein said one side is a bottom side of said insole.

10. An insole (1) constructed of an elastic material having an upper and a lower side (4), said insole (1) having recesses (6) containing exchangeable elastic inserts (8,28) therein, characterized in that the recesses (6) are positioned on the lower side (4) of the insole (1), said insole (1) is provided with a first layer (12,32) comprising a bearing part of a flat adhesive seal (10,30), said bearing part containing spaces corresponding to and overlying said recesses (6) and extending at least over an area directly adjacent to said inserts (8,28), and a second layer (14,34) releasably fastened to the first layer and covering the first layer, the recesses (6), and the inserts (8,28) contained in the recesses (6).

* * * * *